US007610732B2

(12) United States Patent
Griffith

(10) Patent No.: US 7,610,732 B2
(45) Date of Patent: Nov. 3, 2009

(54) MULTI-FACETED END FOR ROOF TRUSS WEB

(75) Inventor: John Edwin Griffith, Swansea Heads (AU)

(73) Assignee: Turb-O-Web International Pty. Limited, Quakers Hill, New South Wales (AU)

( * ) Notice: Subject to any disclaimer, the term of this patent is extended or adjusted under 35 U.S.C. 154(b) by 572 days.

(21) Appl. No.: 10/878,484

(22) Filed: Jun. 29, 2004

(65) Prior Publication Data

US 2005/0166522 A1 Aug. 4, 2005

(51) Int. Cl.
*E04H 12/00* (2006.01)
*E04B 1/32* (2006.01)
*E04H 12/18* (2006.01)

(52) U.S. Cl. ..... 52/638; 52/640; 52/645; 52/693

(58) Field of Classification Search ..... 52/712, 52/715, 634, 636, 638, 639, 640, 645, 644, 52/693, 695

See application file for complete search history.

(56) References Cited

U.S. PATENT DOCUMENTS 2,780,842 A * 2/1957 Hess ..... 52/693
3,452,502 A * 7/1969 Price ..... 52/693
3,867,803 A * 2/1975 Platt ..... 52/693
5,553,961 A * 9/1996 Olden ..... 403/119
6,176,060 B1 * 1/2001 Kennelly et al. ..... 52/639
6,249,972 B1 6/2001 Kennelly et al.
6,401,422 B1 * 6/2002 Olden ..... 52/645
6,412,246 B1 * 7/2002 Tadich ..... 52/633
6,415,511 B1 7/2002 Kennelly et al.
6,688,067 B2 * 2/2004 Kennelly et al. ..... 52/639

* cited by examiner

*Primary Examiner*—Richard E Chilcot, Jr.
*Assistant Examiner*—Jessica Laux
(74) *Attorney, Agent, or Firm*—Nixon & Vanderhye P.C.

(57) ABSTRACT

A segmented end shape for an elongate, parallel-sided wooden web for a roof truss, suitable for use in the Turb-O-Web method of roof truss construction, is shaped as a series of three or more substantially straight facets to approximate a notional part circle, preferably a semicircle having an end-point coinciding with an endmost point of said web. The end shape includes an irregular part polygon having an end point coinciding with the endpoint of the notional part circle, and wherein junctions between one or more adjacent facets of the polygon lie outside the notional part circle and a part of one or more facets lie inside the notional part circle.

23 Claims, 7 Drawing Sheets

MULTI-FACETED END FOR ROOF TRUSS WEB

CROSS-REFERENCE TO RELATED APPLICATION

This application claims priority to AU Application No. 2004900108, filed 09 Jan. 2004. The entire contents of this application are incorporated herein by reference.

BACKGROUND OF THE INVENTION

1. Field of the Invention

The present invention relates to the cutting of segmented-end timber webs of the type used in manufacture of roof trusses by the "Turb-O-Web"™ method. In particular, the invention relates to a segmented end shape for the ends of a roof truss web with three or more straight facets to approximate a semi-circular or other part circular end.

2. Description of Related Art

The Turb-O-Web method of roof truss construction—which is the subject of U.S. Pat. Nos. 6,176,060, 6,249,972, 6,415,511 and 6,688,067—offers substantial efficiency gains in the construction of oblique roof trusses for building construction, by adapting the truss construction to use webs having standardised tapered end shapes and, usually, also predetermined incremental lengths. The contents of those patents are incorporated herein by reference.

The preferred end shapes for the Turb-O-Web method are semicircular, but it is possible to use webs having a segmented end shape which approximates a semicircle by a series of 3 or more, preferably at least 5, straight facets at successive angles (usually 5 facets for 70 mm wide webs or 7 facets for 90 mm wide webs). True semicircular ends give the greatest accuracy, but these require specialised cutting machines. Segmented ends consisting of regular (ie. equal angle) half polygons seeking to simulate a semicircular web end may cause an accumulation of small errors over a succession of webs, causing the web-to-chord joint locations to vary somewhat from the locations predicted by the design software which calculates on the basis of semicircular ends. Greater accuracy can be achieved by increasing the number of facets but this requires saws having more blades than is provided for on the most common types of saws.

SUMMARY OF THE INVENTION

The present invention relates to a segmented web end shape for use in the Turb-O-Web method, which seeks to result in an average accumulated error in joint location which is within acceptable tolerances.

The present invention provides an elongate, parallel-sided wooden web for a roof truss, said web having at least one end thereof shaped as series of three or more substantially straight facets to approximate a notional part circle having an origin, a radius and an endpoint substantially coincident with an endmost point of said web, wherein said end shape comprises an irregular part polygon having an end point substantially coincident with said endpoint of the notional part circle, and wherein junctions between one or more adjacent facets of said polygon lie outside said notional part circle and a part of one or more facets lie inside said notional part circle.

Preferably, the notional part circle is a semicircle.

Preferably, radius of the notional semicircle is substantially one half of the web width. Preferably also, said irregular part polygon is symmetrical about a centreline of said web.

Preferably, the junctions between said one or more adjacent facets lie substantially on a first semicircular locus concentric with and of greater radius than said notional semicircle, and one or more of said facets are substantially tangential to a second semicircular locus concentric with and of lesser radius than said notional semicircle. Preferably, the radii of said first and second semicircular loci differ substantially equally from the radius of the notional semicircle.

Preferably also, the parallel sides of the web extend beyond a perpendicular line passing through the origin of said notional semicircle to meet with respective adjacent facets of said polygon on said first semicircular locus.

In one form, the end shape has an odd number of facets, including an end facet tangential to the notional semicircle at said intersection point of said web centreline and said notional semicircle, and an even number of intermediate facets each meeting with adjacent facets on said first semicircular locus and being tangential to said second semicircular locus.

Preferably, said end shape with an odd number of facets has 5 or 7 facets, most preferably 5.

In an alternative form, the end shape has an even number of facets, including a pair of end facets meeting on the notional semicircle at said intersection point of said web centre line and said notional semicircle, and an even number of intermediate facets each meeting with adjacent facets on said first semicircular locus and being tangential to said second semicircular locus.

Preferably, said end shape with an even number of facets has 4 or 6 facets.

Further aspects of the invention include a roof truss including at least one of the webs, and a stock of webs including a plurality of said webs having a substantially identical end shape, said plurality of webs having discrete lengths at increments between minimum and maximum web lengths.

BRIEF DESCRIPTION OF THE DRAWINGS

Further preferred embodiments will now be further described with reference to the accompanying figures and tables, in which.

DETAILED DESCRIPTION OF PREFERRED EMBODIMENTS

Figure 1:
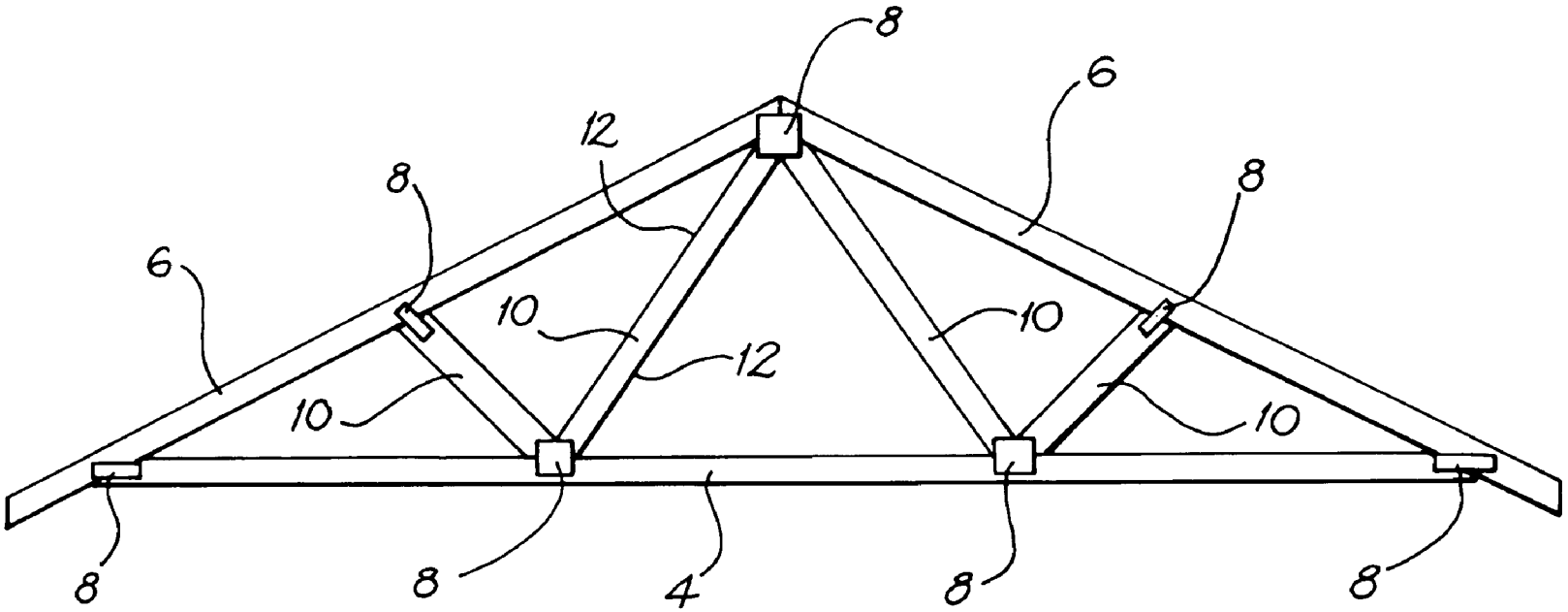
FIG. 1 is a sketch of webs in use in an oblique roof truss.

Referring to FIG. 1 there is schematically illustrated a typical oblique wooden roof truss 2 constructed according to U.S. Pat. No. 6,176,060. The truss consists of a bottom chord 4, a pair of obliquely angled top chords 6, and a plurality of webs 10 extending between the top and bottom chords. The webs 10 and chords 2, 4 of the truss are joined by nail plates 8, as is well understood in the art.

In the truss construction, the position of the end of one web determines the starting position for the next web (usually working outwards from the centre of the truss), and thus any differences in web length or end radius from that expected by the truss-design software may cause an accumulation of errors affecting the start and end positions and the angle of the webs of the truss.

The wooden roof truss webs 10 have parallel sides 12 and are typically rectangular in cross-section, of the cross-sectional dimensions typically used for roof truss webs, eg. 70 mm by 35 mm for Australia or a nominal 2" by 4" board (3½" by 1½") for USA. In trusses of the type made in accordance with U.S. Pat. No. 6,176,060, the ends of the webs are formed with a standardised tapered end shape, typically semicircular with a radius equal to the larger of the two cross-section dimensions.

With reference to FIGS. 2 to 5, the multi-faceted end shapes according to embodiments of the present invention approximate a notional semicircle 16 having its origin 18 on the centreline 20 of the web and having a radius equal to one half of the web width.

The angles and lengths of facets of the end shape are determined by circumscribing an irregular part polygon with the desired number of sides between an inner semicircle 22 of radius ri and an outer semicircle 24 of radius ro, concentric with and equally spaced from the notional semicircle 16.

Figure 2:
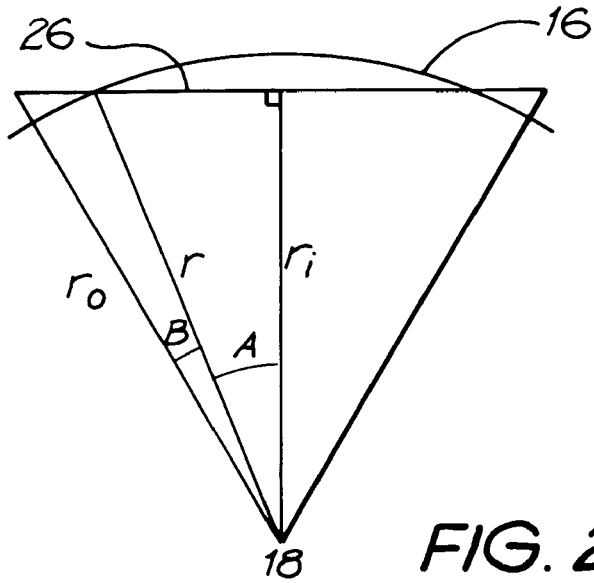
FIG. 2 is a sketch showing construction angles A and B of an intermediate facet of the web end.

FIG. 2 shows the relationship between an intermediate facet 26 and an arc of the notional semicircle 16 having radius r and origin point 18, wherein the facet has minimum distance ri and maximum distance ro from the origin which both differ from radius r by the same amount.

The included angle at the origin 18 of semicircle 16 between the perpendicular line from the centre of the facet 26 to the origin 18 and the radius from origin to the intersection of the semicircle 16 and the facet 26 is designated as Angle A. The included angle at the origin 18 between the radius from origin to the intersection of the semicircle 16 and the facet 26 and the line from the origin 18 to the edge of the facet 26 is designated as Angle B. The included angle at the origin between both ends of the intermediate facet 26 is equal to 2A+2B.

Figure 3:
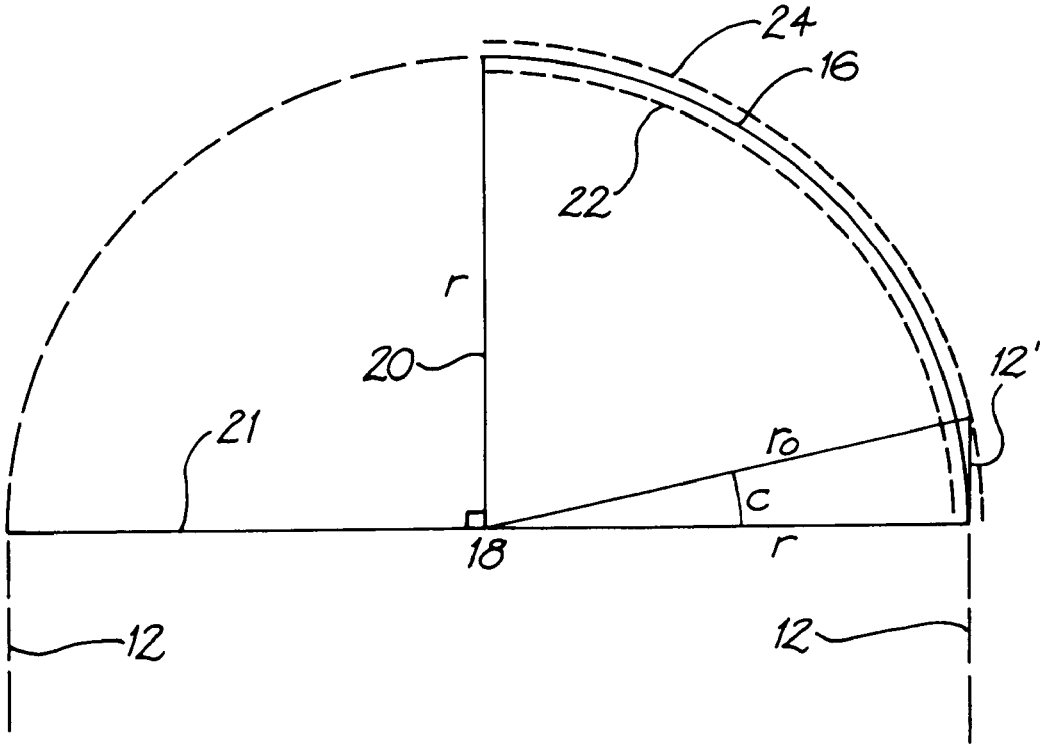
FIG. 3 is a sketch showing construction angle C of an extension of the side of web.

Referring to FIG. 3, the included angle at the origin 18 between a perpendicular 21 to the web centreline 20 and an extension 12' of the side 12 of the web to meet the outer semicircle 24 is designated as angle C.

Figure 4:
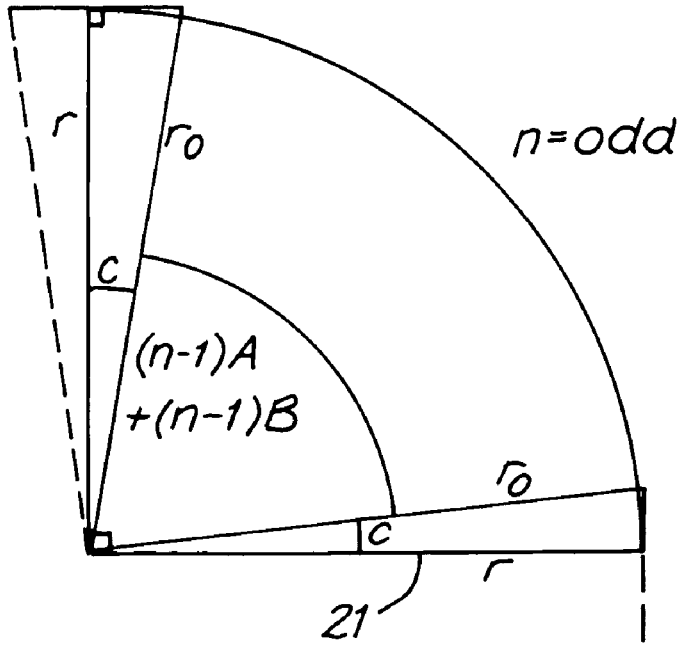
FIG. 4 shows the end facet arrangement of a web end with an odd number of facets.
Figure 6:
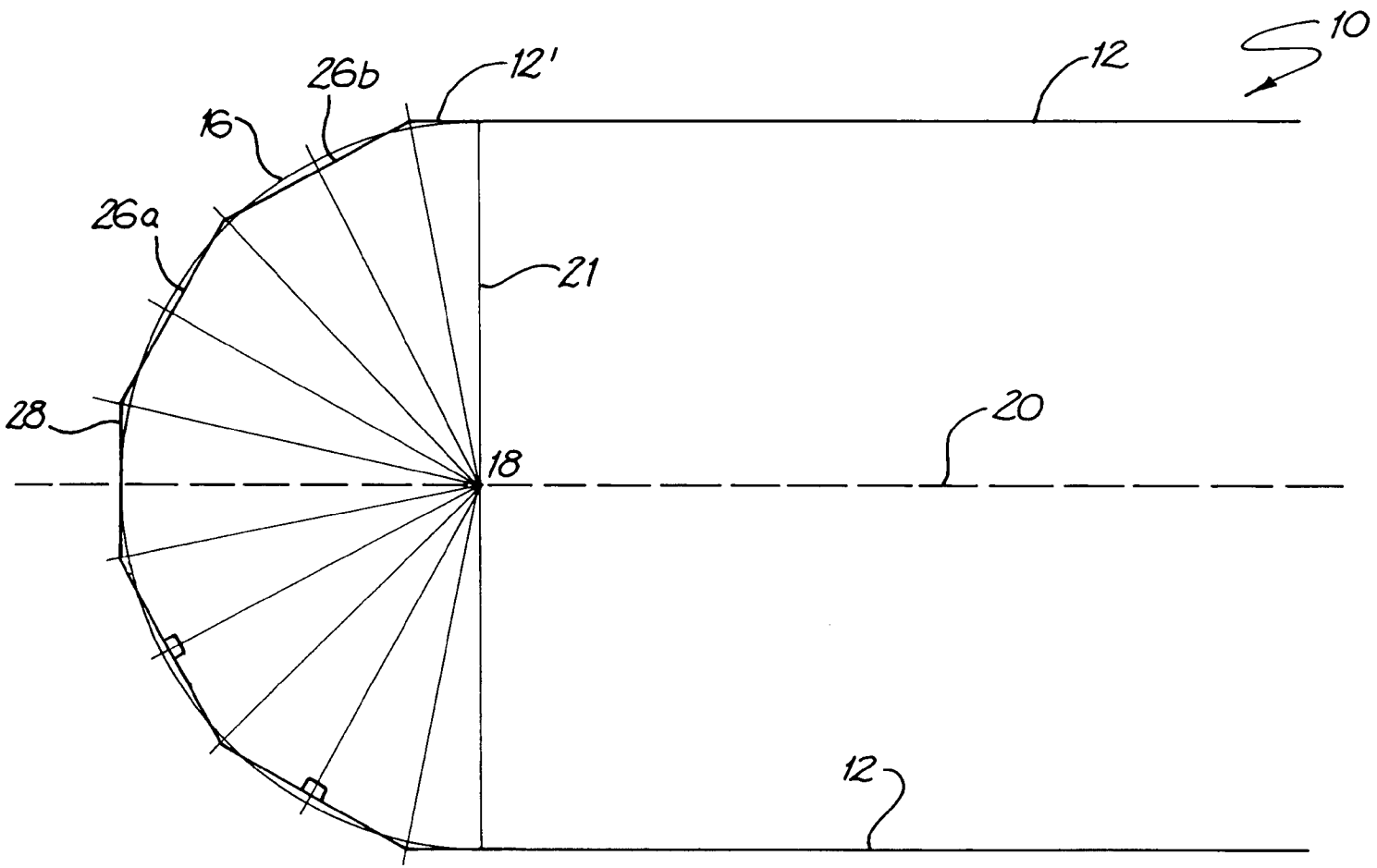
FIG. 6 is a sketch of a multi-faceted web end having 5 facets, showing construction angles.

If there are an odd number of facets, as in FIG. 4 or 6, the end facet 28 of the shape will be perpendicular to the web centreline 20 and tangential to the end of the semicircle 16. The included angle at the origin 18 from the centreline 20 to the edge of the end facet 28 where it intersects the outer semicircle 24 is equal to angle C of the forward extension 12' of the web side 12. That is, the total angular extent (at the origin 18) of the end facet 28 will be twice angle C.

Figure 5:
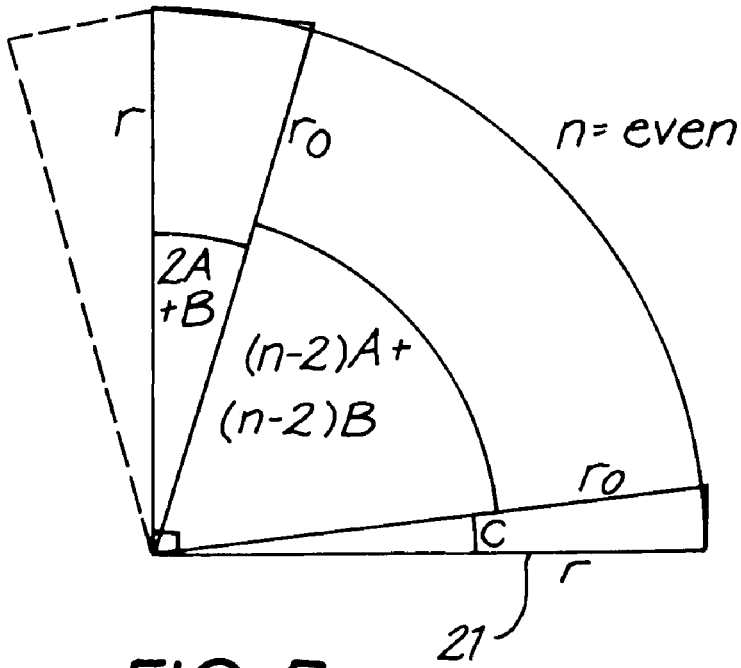
FIG. 5 shows the end facet arrangement of a web end with an even number of facets.
Figure 7:
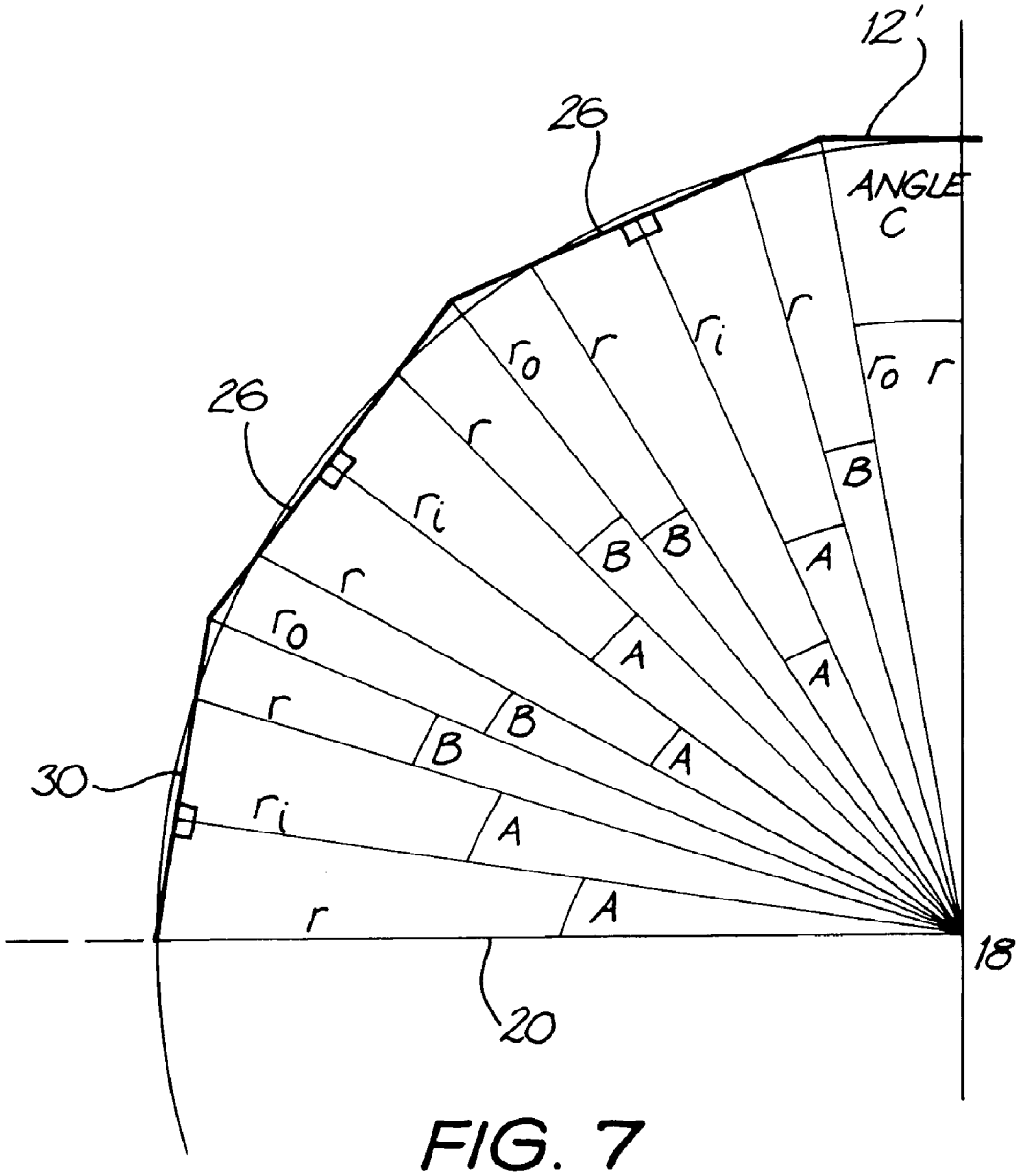
FIG. 7 is a sketch of a quadrant of multi-faceted web end having 6 facets, showing construction angles.

If there is an even number of facets, as in FIG. 5 or 7, the endmost point of the web will be a junction between two end facets 30, at the endpoint of the semicircle. For each of these end facets 30, the angle between the centreline 20 and the end of the end facet 30 where it intersects the outer circle 24 will be an angle of 2A+B In either configuration the endpoint of faceted end shape will coincide with the endpoint of the notional semicircular end 16. Thus, the overall length between the ends of the web will be the same as that of the equivalent web with true semicircular webs.

Between the end of the extension 12' of each side 12 of the web and the respective outer edge of the end facet 28 or end facets 30 will be a number of intermediate facets 26 as shown in FIG. 2—ie. facets tangential to the inner semicircle 22 and with junctions between the facets lying on the outer semicircle 24. Each of these intermediate facets 26 will have a total angular extent (ie. the included angle at the origin) of 2A+2B. For a web end with a total of an odd number n of facets, not including the extensions 12' of the web sides, there will be ½(n−1) of the intermediate facets 26 in each 90° quadrant of the web end. For an even number n of facets in the web end there will be ½(n−2) intermediate facets 26 in each 90° quadrant of the web end.

The angles A, B, and C defining the shape of the irregular polygonal end, and the radii ri and ro of the inner and outer circles from the notional semicircle—defining the maximum deviation of the end shape from the true semicircle—for a given number n of facets are thus determined by the solution to the following set of equations:

$$\cos A = ri/r \tag{1}$$

$$\cos (A+B) = ri/ro \tag{2}$$

$$\cos C = r/ro \tag{3}$$

$$ro + ri = 2r \tag{4}$$

and, if the number of facets n is odd:

$$(n-1)A + (n-1)B + 2C = 90° \tag{5A}$$

or, if the number of facets n is even:

$$nA + (n-1)B + C = 90° \tag{5B}$$

where:

r is the radius of the semicircular end (ie. one half of the web width), n is the number of facets of the end shape, A is the included angle at the origin 18 between where an intermediate facet touches the inner semicircle of radius ri and where that facet crosses the notional semicircle of radius r, B is the included angle at the origin 18 between where an intermediate facet crosses the notional semicircle of radius r and its end on the outer semicircle of radius ro, C is the included angle at origin of the forward extension of the sides of the web to meet the outer semicircle (and where n is odd, will also be the included angle at origin from the centreline 20 to the junction of the end facet and its adjacent facet on the outer semicircle).

It is believed that for a given number of facets there is a unique solution to these equations, and hence a unique irregular polygonal shape satisfying the criteria.

It will be appreciated that the Figures and corresponding description are 2-dimensional representations of a 3-dimensional web end shape of constant shape across the narrow dimension of the web, so that for example each facet is a rectangular face and the junction points between facets are junction lines.

The web end is symmetrical about the centreline 20 of the web, so the other quadrant of the web end is a mirror of that shown. The far end of the web (not shown) will usually be a mirror image of the end shown.

Figure 6A:
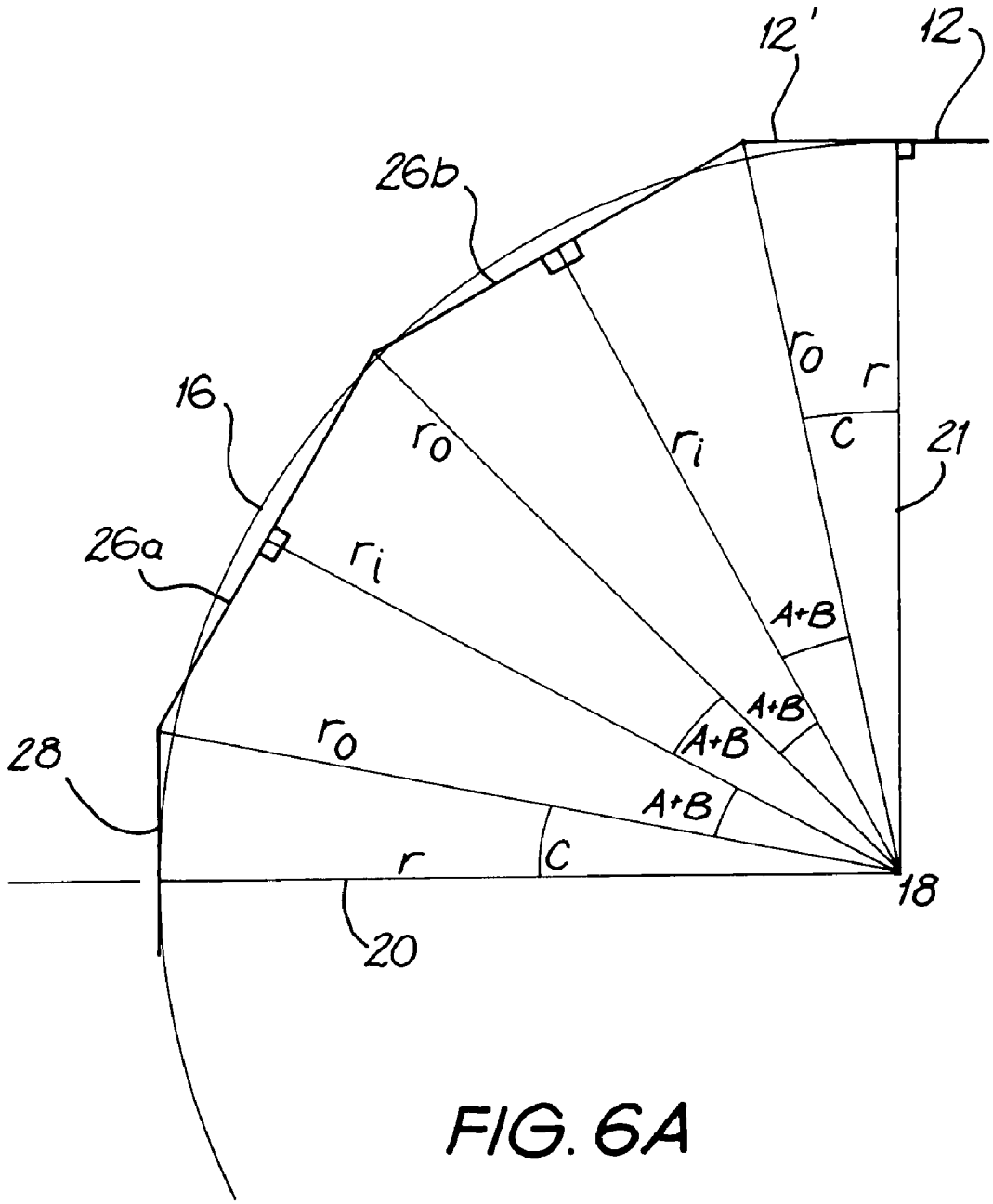
FIG. 6A is a detail of a quadrant of the web end of FIG. 6.

FIGS. 6 and 6A show an end shape having 5 straight facets.

The 5-faceted end shape of FIGS. 6 and 6A has an end facet 28 perpendicular to the web length and tangential to the notional semicircle (ie. touching notional semicircle 16 at its intersection with the web centreline 20). At the side of the web, the parallel sides extend forward 12' to reach the outer circle 24, as described above.

Considering the top 90° quadrant of the faceted end shape of FIG. 6, shown in more detail in FIG. 6A, this quadrant will have two intermediate facets 26*a*, 26*b* each having its ends on the outer circle 24 and touching the inner circle 22 at its midpoint.

Table 1 below is a portion of a spreadsheet table showing iterations for calculation of optimal facet angles for the web end of FIGS. 6 and 6A—a 5 facet end shape with a 45 mm (approx. 1¾ inch) radius—and Table 1A is an expanded iteration of a portion of Table 1.

Tables 1 and 1A solve for the facet angles and inner and outer radii for the end shape of FIGS. 6 and 6A, by an iterative method, according to the equations:

$$\cos A = ri/r \quad (1)$$

$$\cos (A+B) = ri/ro \quad (2)$$

$$\cos C = r/ro \quad (3)$$

$$ro+ri=2r, \text{ and} \quad (4)$$

$$(n-1)A+(n-1)B+2C=90°, \text{ where } n=5 \text{ and } r=45. \quad (5A)$$

TABLE 1

| ro | ri | A | A + B | B | C | sum of angles |
|---|---|---|---|---|---|---|
| 47.00 | 43.00 | 17.15 | 23.81 | 6.66 | 16.77 | 128.78 |
| 46.90 | 43.10 | 16.71 | 23.22 | 6.51 | 16.36 | 125.61 |
| 46.80 | 43.20 | 16.26 | 22.62 | 6.36 | 15.94 | 122.36 |
| 46.70 | 43.30 | 15.80 | 22.00 | 6.20 | 15.51 | 119.00 |
| 46.60 | 43.40 | 15.32 | 21.36 | 6.03 | 15.06 | 115.53 |
| 46.50 | 43.50 | 14.83 | 20.69 | 5.86 | 14.59 | 111.95 |
| 46.40 | 43.60 | 14.33 | 20.00 | 5.68 | 14.11 | 108.24 |
| 46.30 | 43.70 | 13.80 | 19.29 | 5.49 | 13.61 | 104.38 |
| 46.20 | 43.80 | 13.26 | 18.55 | 5.29 | 13.09 | 100.36 |
| 46.10 | 43.90 | 12.69 | 17.77 | 5.08 | 12.54 | 96.17 |
| **46.00** | **44.00** | **12.10** | **16.96** | **4.86** | **11.97** | **91.76** |
| **45.90** | **44.10** | **11.48** | **16.10** | **4.62** | **11.36** | **87.12** |
| 45.80 | 44.20 | 10.82 | 15.19 | 4.37 | 10.72 | 82.20 |
| 45.70 | 44.30 | 10.12 | 14.22 | 4.10 | 10.04 | 76.95 |
| 45.60 | 44.40 | 9.37 | 13.17 | 3.81 | 9.30 | 71.30 |
| 45.50 | 44.50 | 8.55 | 12.03 | 3.49 | 8.50 | 65.14 |
| 45.40 | 44.60 | 7.64 | 10.77 | 3.13 | 7.61 | 58.31 |
| 45.30 | 44.70 | 6.62 | 9.34 | 2.72 | 6.60 | 50.53 |
| 45.20 | 44.80 | 5.40 | 7.63 | 2.22 | 5.39 | 41.29 |
| 45.10 | 44.90 | 3.82 | 5.40 | 1.58 | 3.82 | 29.22 |
| 45.00 | 45.00 | 0.00 | 0.00 | 0.00 | 0.00 | 0.00 |

TABLE 1A

| ro | ri | A | A + B | B | C | sum of angles |
|---|---|---|---|---|---|---|
| 46.00 | 44.00 | 12.10 | 16.96 | 4.86 | 11.97 | 91.76 |
| 45.99 | 44.01 | 12.04 | 16.87 | 4.83 | 11.91 | 91.31 |
| 45.98 | 44.02 | 11.98 | 16.79 | 4.81 | 11.85 | 90.85 |
| 45.97 | 44.03 | 11.92 | 16.70 | 4.79 | 11.79 | 90.40 |
| **45.96** | **44.04** | **11.86** | **16.62** | **4.76** | **11.73** | **89.94** |
| 45.95 | 44.05 | 11.79 | 16.53 | 4.74 | 11.67 | 89.47 |
| 45.94 | 44.06 | 11.73 | 16.45 | 4.72 | 11.61 | 89.01 |
| 45.93 | 44.07 | 11.67 | 16.36 | 4.69 | 11.55 | 88.54 |
| 45.92 | 44.08 | 11.60 | 16.27 | 4.67 | 11.49 | 88.07 |
| 45.91 | 44.09 | 11.54 | 16.19 | 4.64 | 11.43 | 87.60 |
| 45.90 | 44.10 | 11.48 | 16.10 | 4.62 | 11.36 | 87.12 |

The rows of Tables 1 and 1A shown in bold give the closest fit.

It can be seen that the best solution for a 5-faceted end is found where Angle A is approximately 11.86 degrees, Angle B is approximately 4.76 degrees and Angle C is approximately 11.73 degrees, giving the 5-faceted web end a maximum deviation from the radius r of the semicircle of less than 1 mm for a 90 mm wide board. Even greater accuracy can be achieved if the angles of the cutting of the facets can be more closely controlled, but in practice this is well inside the allowable tolerances for cutting of the webs. Furthermore, the maximum deviations from the semicircular are of equal amounts either side of the true radius, and thus when assembling a roof truss with such webs the deviations will tend to average each other out, for example when a peak the end of one web abuts with the flat facet surface on the end of the adjacent web.

FIG. 7 and Tables 2 and 2A below show similar calculations for an end shape with 6 facets and a 45 mm radius, according to the equations:

$$\cos A = ri/r \quad (1)$$

$$\cos (A+B) = ri/ro \quad (2)$$

$$\cos C = r/ro \quad (3)$$

$$ro+ri=2r, \text{ and} \quad (4)$$

$$nA+(n-1)B+C=90°, \text{ where } n=6 \text{ and } r=45. \quad (5B)$$

TABLE 2

| ro | ri | A | A + B | B | C | sum of angles |
|---|---|---|---|---|---|---|
| 47.00 | 43.00 | 17.15 | 23.81 | 6.66 | 16.77 | 159.62 |
| 46.90 | 43.10 | 16.71 | 23.22 | 6.51 | 16.36 | 155.69 |
| 46.80 | 43.20 | 16.26 | 22.62 | 6.36 | 15.94 | 151.65 |
| 46.70 | 43.30 | 15.80 | 22.00 | 6.20 | 15.51 | 147.49 |
| 46.60 | 43.40 | 15.32 | 21.36 | 6.03 | 15.06 | 143.19 |
| 46.50 | 43.50 | 14.83 | 20.69 | 5.86 | 14.59 | 138.74 |
| 46.40 | 43.60 | 14.33 | 20.00 | 5.68 | 14.11 | 134.14 |
| 46.30 | 43.70 | 13.80 | 19.29 | 5.49 | 13.61 | 129.36 |
| 46.20 | 43.80 | 13.26 | 18.55 | 5.29 | 13.09 | 124.37 |
| 46.10 | 43.90 | 12.69 | 17.77 | 5.08 | 12.54 | 119.17 |
| 46.00 | 44.00 | 12.10 | 16.96 | 4.86 | 11.97 | 113.71 |
| 45.90 | 44.10 | 11.48 | 16.10 | 4.62 | 11.36 | 107.95 |
| 45.80 | 44.20 | 10.82 | 15.19 | 4.37 | 10.72 | 101.85 |
| **45.70** | **44.30** | **10.12** | **14.22** | **4.10** | **10.04** | **95.35** |
| **45.60** | **44.40** | **9.37** | **13.17** | **3.81** | **9.30** | **88.34** |
| 45.50 | 44.50 | 8.55 | 12.03 | 3.49 | 8.50 | 80.70 |
| 45.40 | 44.60 | 7.64 | 10.77 | 3.13 | 7.61 | 72.24 |
| 45.30 | 44.70 | 6.62 | 9.34 | 2.72 | 6.60 | 62.61 |
| 45.20 | 44.80 | 5.40 | 7.63 | 2.22 | 5.39 | 51.16 |
| 45.10 | 44.90 | 3.82 | 5.40 | 1.58 | 3.82 | 36.20 |
| 45.00 | 45.00 | 0.00 | 0.00 | 0.00 | 0.00 | 0.00 |

TABLE 2A

| ro | ri | A | A + B | B | C | sum of angles |
|---|---|---|---|---|---|---|
| 45.70 | 44.30 | 10.12 | 14.22 | 4.10 | 10.04 | 91.17 |
| 45.69 | 44.31 | 10.05 | 14.12 | 4.07 | 9.97 | 90.52 |
| **45.68** | **44.32** | **9.97** | **14.02** | **4.04** | **9.90** | **89.87** |
| 45.67 | 44.33 | 9.90 | 13.91 | 4.01 | 9.83 | 89.22 |
| 45.66 | 44.34 | 9.82 | 13.81 | 3.99 | 9.75 | 88.55 |
| 45.65 | 44.35 | 9.75 | 13.71 | 3.96 | 9.68 | 87.89 |
| 45.64 | 44.36 | 9.67 | 13.60 | 3.93 | 9.61 | 87.22 |
| 45.63 | 44.37 | 9.60 | 13.50 | 3.90 | 9.53 | 86.54 |
| 45.62 | 44.38 | 9.52 | 13.39 | 3.87 | 9.46 | 85.85 |
| 45.61 | 44.39 | 9.44 | 13.28 | 3.84 | 9.38 | 85.17 |
| 45.60 | 44.40 | 9.37 | 13.17 | 3.81 | 9.30 | 84.47 |

The rows of Tables 2 and 2A shown in bold give the closest fit.

It will be noted that where there is in total an even number of facets employed, such as in FIG. 7, there are two end facets 30 which join at an angle at the intersection of the centreline 20 with the semicircle 16 as described above for FIG. 6. It can be seen that the best solution for a 6-faceted end is found where Angle A is approximately 9.97 degrees, Angle B is approximately 4.04 degrees and Angle C is approximately 9.90 degrees, giving the 5-faceted web end a maximum deviation from the radius r of the semicircle of less than 0.7 mm for a 90 mm wide board.

The following Table 3 is a summary table of the construction Angles A, B and C for a number of different faceted end configurations for a 90 mm wide web.

TABLE 3

| | | | 90 mm Wide Board | | | | |
|---|---|---|---|---|---|---|---|
| # End Facets n | Angle A degrees A | Angle B degrees B | Angle C degrees C | outer radius mm $r_o$ | Radius Mm R | inner radius mm $r_i$ | $(r_o - r_i)/2$ mm $(r_o - r_i)/2$ |
| 3 | 19.099 | 7.309 | 18.59 | 47.477 | 45 | 42.523 | 2.477 |
| 4 | 14.584 | 5.768 | 14.353 | 46.45 | 45 | 43.55 | 1.45 |
| 5 | 11.863 | 4.766 | 11.738 | 45.961 | 45 | 44.039 | 0.961 |
| 6 | 9.978 | 4.045 | 9.903 | 45.681 | 45 | 44.319 | 0.681 |
| 7 | 8.634 | 3.519 | 8.585 | 45.51 | 45 | 44.49 | 0.51 |

For a given number of facets n, the angles A,B and C defining the end shape will stay the same regardless of the radius r, with the maximum deviation from the semicircular varying proportionally to the radius r.

An advantage of the present invention is that it allows acceptable tolerance to be reached with as few cuts as possible, for example with 5 facets on the 3½ inch wide webs commonly used in USA. In conjunction with the Applicant's co-pending Australian Patent Application No 2004900109 filed 9 Jan. 2004—which teaches a 2-pass technique for cutting a 5-faceted end shape using a saw of the type conventionally employed by roof truss manufacturers to cut conventional custom angle cut webs, adoption of the Turb-O-Web system is further simplified. The contents of that patent application are incorporated herein by reference.

Figure 8:
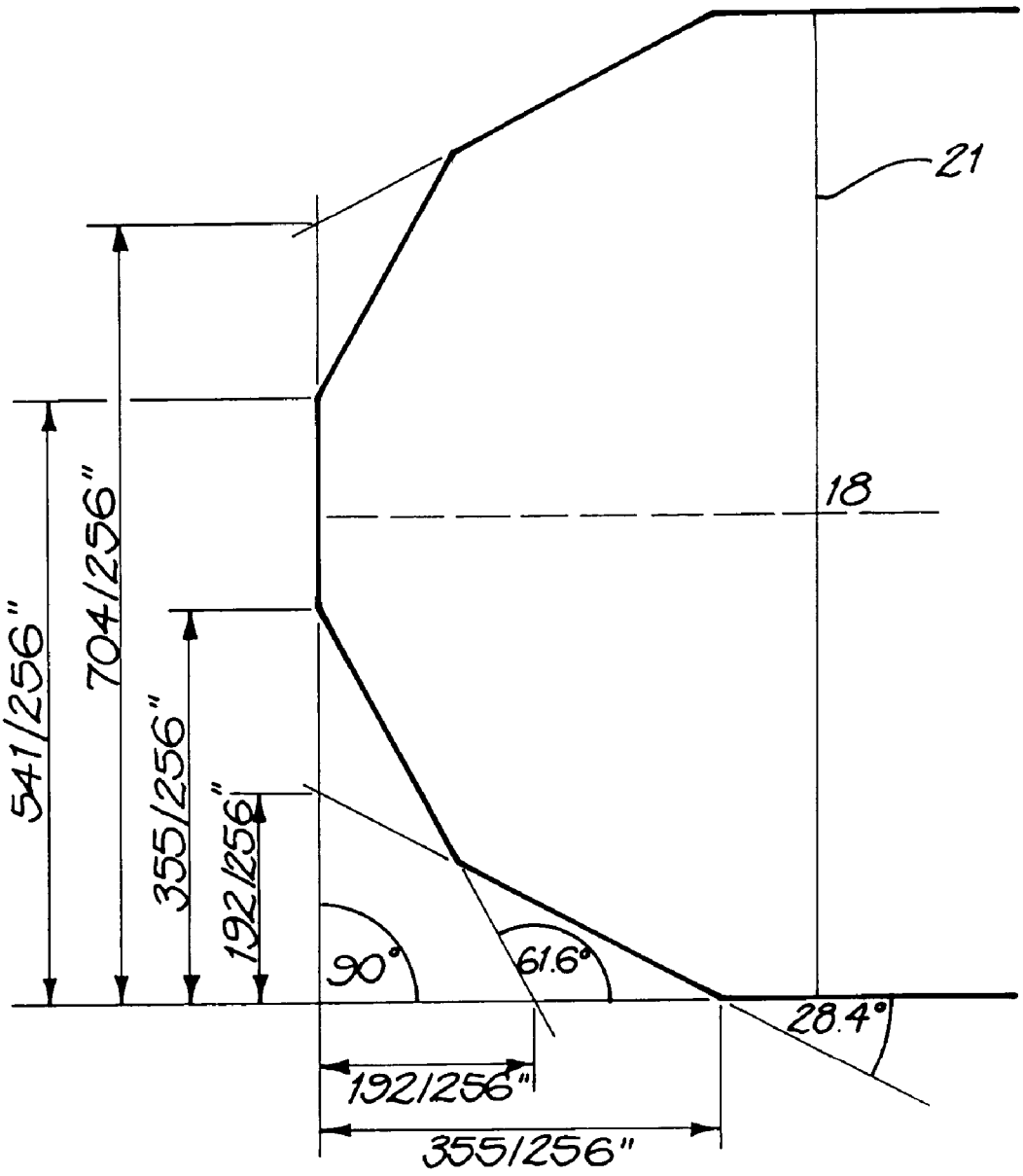
FIG. 8 is a sketch of a 5-faceted web end showing cutting blade angles and positions.

FIG. 8 is a schematic of the end shape of FIG. 6, showing the saw blade angles and positions for cutting the shape, expressed to the tolerances used in USA for cutting truss components—lengths tolerances of $1/16^{th}$ inch expressed in $1/256^{th}$ inch increments and angles expressed as angles from the board axis to the nearest 0.1°.

Furthermore, as the Turb-O-Web method uses a replicated end shape for the webs of the roof truss, once the number of facets to be used and width of timber are decided upon and the saw angles set accordingly, the saw angles need not be changed. This makes the web cutting task amenable to implementation by an older style saw, without electronic control, as a dedicated web cutting saw. Such saws are available cheaply as adjustment of the cutting angles of such saws is slow, but this is not a consideration in the present case, as the cutting angles may be set either permanently or by use of a template. Great accuracy can be attained, as the saw angles can be set permanently or semi-permanently and the length varied to cut batches of different length webs Web cutting according to the invention is also amenable to cutting by saws having limited electronic control capabilities, such as those having electronic control and adjustment of length but manual adjustment of the blade angle.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise, comprised and comprises where they appear.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, the scope of the invention being indicated by the appended claims rather than the foregoing description, and all changes which come within the meaning and range of equivalency of the claims are therefore intended to be embraced therein. It will further be understood that any reference herein to known prior art does not, unless the contrary indication appears, constitute an admission that such prior art is commonly known by those skilled in the art to which the invention relates.

The invention claimed is:

1. An elongate, parallel-sided wooden web for a roof truss, said web having at least one end thereof configured on said web so as to determine in use a joint location between said wooden web and a chord of said roof truss and with an adjacent web of said truss having a similar end, said end being shaped so as to mitigate error accumulation, said at least one end being shaped as series of three or more substantially straight facets to approximate a semicircle having an origin, a radius being substantially one half of a width of said web and an endpoint substantially coincident with an endmost point of said web, wherein said end shape comprises an irregular part polygon having an end point substantially coincident with said endpoint of the semicircle, and wherein junctions between one or more adjacent facets of said polygon lie outside said semicircle substantially on a first semicircular locus concentric with and of greater radius than said semicircle and a part of one or more facets lie inside said semicircle and are substantially tangential to a second semicircular locus concentric with and of lesser radius than said semicircle.

2. A web according to claim 1, wherein said irregular part polygon is symmetrical about a centreline of said web.

3. A web according to claim 1, wherein said radii of said first and second semicircular loci differ substantially equally from the radius of the semicircle.

4. A web according to claim 1, wherein said parallel sides of the web extend beyond a perpendicular line passing through the origin of said semicircle to meet with respective adjacent facets of said polygon on said first semicircular locus.

5. A web according to claim 1, wherein said the end shape has an odd number of facets, including an end facet tangential to the semicircle at said intersection point of said web centreline and said semicircle, and an even number of intermediate facets each meeting with adjacent facets on said first semicircular locus and being tangential to said second semicircular locus.

6. A web according to claim 1, wherein said end shape with an odd number of facets has five facets.

7. A web according to claim 1, wherein said end shape with an odd number of facets has seven facets.

8. A web according to claim 1, wherein said end shape has an even number of facets, including a pair of end facets meeting on the semicircle at said intersection point of said web centreline and said semicircle, and an even number of intermediate facets each meeting with adjacent facets on said first semicircular locus and being tangential to said second semicircular locus.

9. A web according to claim 8, wherein said end shape with an even number of facets has four facets.

10. A web according to claim 8, wherein said end shape with an even number of facets has six facets.

11. A web according to claim 1, wherein said web is rectangular in transverse cross section, said cross section having a major axis dimension, and wherein said radius is substantially one half of said major axis dimension.

12. A web according to claim 11, wherein said major axis dimension is approximately 90 mm and wherein said end shape has five facets.

13. A web according to claim 12, wherein said parallel sides of the web extend beyond a perpendicular line passing through the origin of said semicircle to meet with respective adjacent facets of said polygon outside said semicircle.

14. A web according to claim 13, wherein an included angle at the origin between said perpendicular line and a junction between a said web side and its adjacent facet is approximately 12 degrees.

15. A web according to claim 14 including an end facet tangential to the semicircle at said intersection point of said web centreline and said semicircle, and an even number of intermediate facets, wherein said end facet defines an included angle at the origin of approximately 24 degrees and each said intermediate facet defines an included angle at the origin of approximately 33 degrees.

16. A web according to claim 1, wherein two or more of said junctions lie on said first semicircular locus.

17. A web according to claim 1, wherein all of said junctions lie on said first semicircular locus.

18. A web according to claim 1, wherein two or more of said facets are tangential to said second semicircular locus.

19. A web according to claim 1, wherein all of said facets are tangential to said second semicircular locus.

20. A wooden roof truss including a bottom chord and at least one upper chord, the upper and bottom chords being connected by webs by means of nail-plated joints, characterised in that at least one of said webs is a web according to claim 1.

21. A stock of webs for use in construction of oblique wooden roof trusses, comprising a plurality of structural wooden webs according to claim 1 having a substantially identical end shape, said plurality of webs having discrete lengths at increments between minimum and maximum web lengths.

22. A stock of webs according to claim 21 wherein said discrete lengths are at substantially equal increments.

23. A stock of webs according to claim 22 wherein said increments are approximately 150 mm.

* * * * *